US006010106A

United States Patent [19]

Commissar

[11] Patent Number: 6,010,106

[45] Date of Patent: Jan. 4, 2000

[54] DISPLAY BOARD

[75] Inventor: Richard Clive Commissar, London, United Kingdom

[73] Assignee: Posit Design Ltd., London, United Kingdom

[21] Appl. No.: 08/921,280

[22] PCT Filed: Mar. 1, 1996

[86] PCT No.: PCT/GB96/00487

§ 371 Date: Aug. 29, 1997

§ 102(e) Date: Aug. 29, 1997

[87] PCT Pub. No.: WO96/26660

PCT Pub. Date: Sep. 6, 1996

[30] Foreign Application Priority Data

Mar. 2, 1995 [GB] United Kingdom ..... 9504231

[51] Int. Cl.[7] ..... A47B 97/04

[52] U.S. Cl. ..... 248/459; 248/174; 248/451; 281/34

[58] Field of Search ..... 248/451, 452, 248/453, 459, 441.1, 174 XE, 300, 152; 40/341; 281/46, 47, 45, 49, 34; 283/36; 116/234

[56] References Cited

U.S. PATENT DOCUMENTS

| | | | |
|---|---|---|---|
| 912,775 | 2/1909 | Ayvad | 281/34 |
| 1,519,948 | 12/1924 | Zuckerman | 281/34 |
| 4,479,318 | 10/1984 | Russell | 40/154 |
| 4,589,682 | 5/1986 | Balland | 281/46 |
| 4,645,237 | 2/1987 | Squire et al. | 281/47 |
| 4,819,964 | 4/1989 | Dupuis | 281/35 |
| 5,087,078 | 2/1992 | Phillips | 281/31 |
| 5,152,492 | 10/1992 | Foisy | 248/488 |
| 5,237,956 | 8/1993 | Igeta | 116/234 |
| 5,249,546 | 10/1993 | Pennelle | 116/234 |

FOREIGN PATENT DOCUMENTS

| | | |
|---|---|---|
| 2 355 999 | 5/1974 | Germany . |
| 647 460 | 1/1985 | Switzerland . |
| 1 442 312 | 7/1976 | United Kingdom . |
| 2 281 716 | 3/1995 | United Kingdom . |
| 2 287 432 | 9/1995 | United Kingdom . |
| 2 300 152 | 10/1996 | United Kingdom . |

*Primary Examiner*—Ramon O. Ramirez
*Assistant Examiner*—Anita M. King
*Attorney, Agent, or Firm*—Darby & Darby

[57] ABSTRACT

A display board including a pair of opposing edges 1, 1' with at least one flap 3, 3', 4, 4' at each edge. The flaps between them holding a fold-over article, such as a magazine. Each flap being foldable along the edge 1, 1' onto the display board, so that the flap will be inside the fold-over article when that article is on the display board. The flap, or a part of the flap, is also foldable at right angles to the edge, so that upon mounting of the article on the board, folding the flap inside the article adjacent its spine and then folding the article onto itself, party of the flap B can be arranged on top of the article with the right angle fold 7 of the flap behind the spine of the article, whereby the article is prevent from falling off the display board.

30 Claims, 5 Drawing Sheets

DISPLAY BOARD

BACKGROUND OF THE INVENTION

1. Field of the Invention

The present invention relates to a display board on which can be temporarily mounted at least one "fold-over article". By the term "fold-over article" is meant any article that is formed in the manner of a book, i.e. can be folded over onto itself along a fold-line or spine. The invention is particularly suitable for displaying magazines, but could be used for any other article formed in a similar fashion. Such other articles could be, for example, folders, promotional materials, cards, calendars and other items which are sold in a folded state, such as textile articles, socks, tights, etc.

2. Description of Related Art

It is sometimes desired to mount an article on a display board, for example to increase its impact in a retail outlet. The display board can be used to show information and/or pictures beyond what is shown on the article itself. In the case of magazines, the display board could be used to give greater prominence to a particular edition of a magazine and/or could be used to hold both a magazine and a free supplement.

Conventionally, if a magazine is supplied with a supplement, the two publications are provided with a band around them or are provided together in a clear plastic bag. In either case, it is difficult for a potential purchaser to look inside either the magazine or its supplement. An alternative approach would be mount the two publications on a backing card, but if this were done with adhesives or sticky tape then the publications could be damaged when they were removed from the card. The backing card could be provided with a pair of long flaps which are folded inside each publication and joined to form a loop (along the length of the spine), but this would not solve the problem of keeping the publications securely together and on the backing card; in other words, the publications could fall out of the loop formed by the folded flaps unless an adhesive or tape were used.

SUMMARY OF THE INVENTION

It is an object of the invention to provide an improved display board which is both simple to produce and can securely hold at least one fold-over article.

Accordingly, the invention provides a display board comprising a pair of opposing edges with at least one flap at each edge, the flaps between them being capable of holding a fold-over article, each flap being capable of folding along the edge onto the display board, so that it will be inside the fold-over article when that article is on the board, and wherein the flap or a part of the flap is also capable of being folded at right angles to the edge, so that upon mounting of the article on the board, folding the flap inside the article adjacent its spine and then folding the article onto itself, part of the flap can be arranged on top of the article with the right angle fold of the flap behind the spine of the article, whereby the article is prevented from falling off the display board.

Thus, with the invention, a fold-over article is held on the board, until the user chooses to take it off, in the following ways: firstly, the article is prevented from moving significantly in one direction by the fold lines at the opposing edges—for convenience this can be considered as a forwards and backwards direction; secondly, the article is prevented from moving side to side by one flap part inside the article, near to the spine, and the fold of the flap part on the outside of the spine of the article; thirdly, the article is of course prevented from moving up off the board by the flap parts both inside and outside the article.

In practice, the flaps would generally be formed integrally with the display board, so as to minimize costs, and the display board may be formed of card or cardboard out of which the flaps can easily be cut. The flaps can conveniently be provided at or adjacent the outer edges of the display board so that said opposing edges follow the periphery of the board. Needless to say, the gap between the opposing edges is substantially matched to the height or spine length of the article to be mounted on the display board.

Each flap may be formed of a first flap part which, in its open state, extends out of the board and a second flap part which is cut into the board, the right angle fold line being formed in the board from the inner end of the cut of the second flap part to the edge of the board.

In an another embodiment, each flap can be formed of at least four flap parts which extend out of the board, first and second flap parts folding onto one another to form a flap which folds inside the article, and the remaining flap parts providing the right angle fold and together forming a part which extends outside the article, behind its spine. In this embodiment, each flap may be cut out of the body of the board and bent away from the board before the article is mounted thereon.

Adjacent each flap there may also be a second flap which simply folds inside the article when it is mounted on the display board. When the article is itself folded over to close it, the two flaps, one either side of the spine of the article, will be abutting. For greater security the abutting flaps are preferably provided on their faces with an adhesive so that when the article is closed the flaps will automatically be joined together.

Since the display board may be required to hold more than one article, there could be two or more sets of flaps, each flap on one edge having a counterpart on the opposite edge of the board. On the same board, it is to be expected that each flap would be formed in the same way, though if for some reason it was desired to have different designs of flaps on the same board then this is entirely possible as long as each flap performs the desired function.

The folds of the flaps could be provided, in a conventional fashion, by score lines, perforations or creases in the material of the board, generally card or cardboard. To accommodate different thicknesses of articles, the folds could of course be formed with a pair of creases to provide a specific fold thickness. Alternatively, the folds could be formed with a plurality of creases to accommodate different thicknesses of article.

The display board will generally include a display area, not covered by the mounted article or articles, on which additional information or pictures can be included. However, if it is merely desired to mount two or more articles together on the same board, or mount a single article without wanting to include extra information, then the display area can be dispensed with.

BRIEF DESCRIPTION OF THE DRAWINGS

Preferred embodiments of the invention are described in more detail below, by example, and with reference to the accompanying drawings, wherein.

DETAILED DESCRIPTION OF THE PREFERRED EMBODIMENTS

Figure 1:
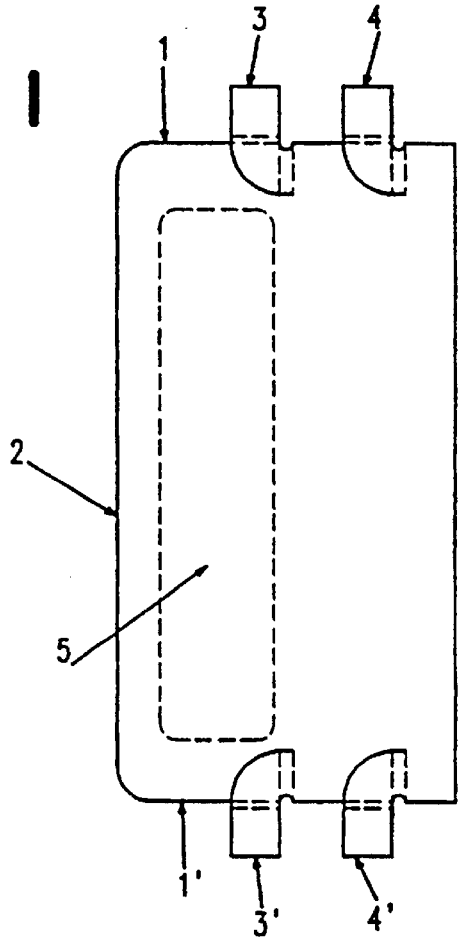
FIG. 1 shows a display board according to the invention, with two flaps at either edge.

The display board shown in FIG. 1 is generally rectangular in shape and includes opposing edges 1, 1' and 2, 2'. On edge 1 are arranged a pair of flaps 3, 4 and at corresponding positions on the opposite edge 1' are arranged flaps 3' and 4'. The display board includes a display area 5, shown in dashed lines, this area remaining visible after one or more fold-over articles have been mounted on the board, as explained below.

The display board will typically be made of card or cardboard, with the flaps formed integrally with the card. In other words, the board and flaps can together be punched out of a larger piece of card. In the alternative, the display board could be formed, for example, of a relatively rigid plastics material with the foldable flaps bonded thereto by any conventional fashion.

The display board can usefully be employed for mounting one or more magazines, for example one magazine plus a special supplement. In the following description, the mounting of only magazines is discussed, but it should be understood that the display boards are equally useful for mounting other sorts of fold-over articles.

Figure 2A:
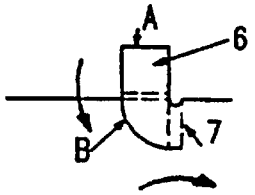
FIGS. 2*a* to 2*d* show details of the board of FIG. 1, with one flap at different stages of folding.

As shown in FIG. 2*a*, each flap consists of flap part A and flap part B, flap part A extending away from the board (in its unfolded state) and flap part B being cut into the board. Flap part A is generally square in shape; flap part B is in the shape of a quarter circle. A fold line 6 divides flap part A from flap part B, fold line 6 following the line of the edge 1 of the board. Flap part A can thus fold over onto the board.

Flap part B is formed by a cut in the board, this cut extending in an arc from one side of flap part A at the edge of the board to a point immediately inward of the other side of flap part A. Between that other side of flap part A at the end of the cut is a fold line 7. Fold line 7 extends substantially at right-angles to the edge of the board, so that flap part B (with flap part A attached) can fold over in a direction perpendicular to the folding of flap part A.

The folding of flap part A and then the folding of flap part B are schematically indicated by the arrows on FIG. 2*a*.

Figure 2B:
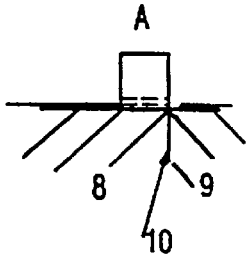

FIG. 2*b* shows the display board with a magazine placed thereon. For clarity, only part of the magazine and part of the display board are seen in the drawing. The magazine consists of front part 8 and a rear part 9, separated by a fold or spine 10. The magazine is located so that its spine is on the right hand side of the flap. The magazine will be opened along its middle, so that the front and rear parts consist of the same number of pages.

Figure 2C:
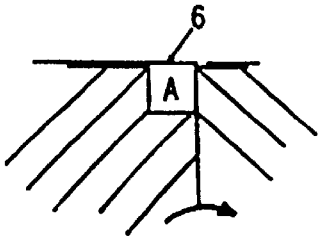

FIG. 2*c* shows flap part A folded over onto the front part of the magazine, immediately to the left side of spine 10. It can be seen that if the rear half of the magazine were folded on top of the front half (contrary to what is intended) the magazine would be loosely held on the display board and would be prevented from moving to the left of the board by flap part A; in addition flap part A would help stop the magazine moving up off the board (particularly if it were longer) and fold-line 6 would stop the magazine moving up or down. However, there would be nothing to prevent the magazine from sliding out to the right of the board.

Figure 2D:
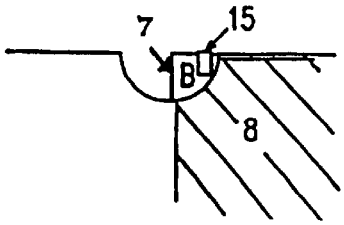

As shown in FIG. 2*d*, the second folding of the flap prevents the magazine from sliding out in either direction. Thus, with folding of the front half of the magazine onto the rear half, with flap part A inside the magazine, flap part B is folded over along fold line 7. When the magazine is closed, flap part B is thus outside the magazine, helping to hold it on the board, and fold-line 7 is immediately behind the spine of the magazine, stopping it from moving to the left. Flap part A is inside the magazine and has been folded over with the front part B of the magazine so that it is now to the right of the spine 10; flap part A thus prevents the magazine from moving to the right.

In practice, the folded flaps may unfold if the display board and magazines are not handled carefully. Accordingly, flap part B can be fixed to the display board by a suitable adhesive tape, as indicated by reference numeral 15 in FIG. 2*d*. The tape does not, however, come into contact with the surface of the magazine and so does not cause any damage on its removal.

It will be understood that as the flaps are relatively narrow, as compared to the width of the magazines, they do not significantly inhibit the ability of a potential purchase to browse through the magazines and/or special supplements.

Figure 3A:
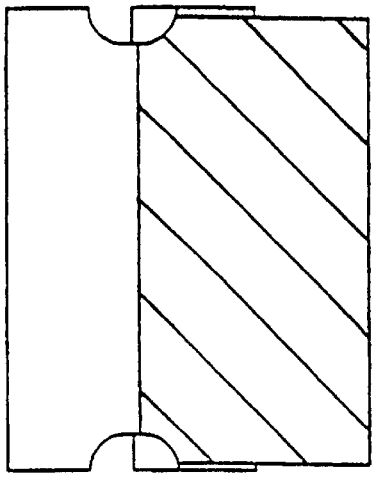
FIG. 3*a* shows a display board with a single flap at either edge folded according to FIGS. 2*a* to 2*d* and holding one folded article.

FIG. 3*a* shows a display board for mounting a single magazine, the magazine also being shown in its supported position, with the flap on either opposite edge being folded according to FIGS. 2*a* to 2*d*.

Figure 3B:
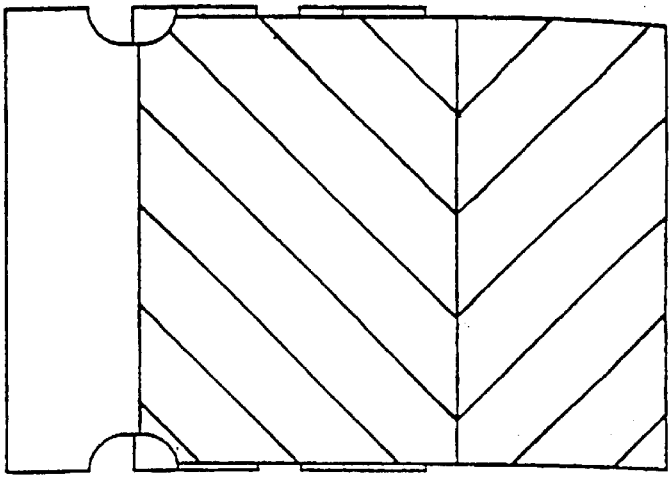
FIG. 3*b* shows the board of FIG. 1, with both sets of flaps folded and holding two fold-over articles.

FIG. 3*b* is a view similar to that of FIG. 3*a*, but with two magazines supported on a display board, i.e. the display board is as illustrated in FIG. 1 with two sets of flaps. The flaps are folded according to FIGS. 2*a* to 2*d*, flaps 4 and 4' being folded first, onto the first magazine, and flaps 3 and 3' being folded second on the second magazine. Thus, the second magazine is on top of the first, but both are held in the same manner. This arrangement is particular suitable for a special issue of a magazine which comes with a free supplement. Thus, both the magazine and supplement can be mounted together in such a fashion that information about the special edition and the supplement can be given on the display area of the board and in such a manner that both the magazine and its supplement can be looked at by a potential customer. Furthermore, the magazine and its supplement can easily be removed without damage by pushing back the folded flaps and discarding the display board (this of course applies to all the illustrated embodiments).

Figure 4A:
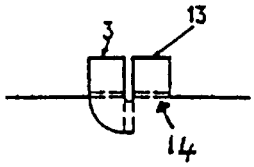
FIGS. 4*a* to 4*d* show details of a second embodiment of the display board, with the flaps at different stages of folding.
Figure 4B:
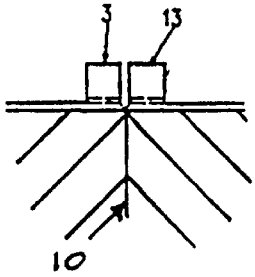
Figure 4C:
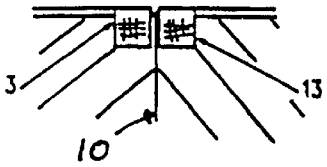

In the embodiments shown in FIGS. 4*a* to 4*d*, each flap of the display board (whether there are in total two flaps, four flaps, six flaps etc.) is formed with a second, adjacent flap so as to form a flap pair. The first flap 3 of the flap pair can be the same as that shown in FIGS. 1 and 2; the second flap 13 of the flap pair has only one flap part and simply folds about a fold-line 14 which follows the edge of the board. As shown in FIG. 4*b*, to mount a magazine on the board it is placed on the board in an open position, similar to that shown in FIG. 2*b*. Both the first and second flaps 3, 13 of the flap pair are folded on top of the magazine, one on either side of the spine. The first flap 3 of the flap pair is to the left of the spine, as in FIG. 2*c*. The surfaces of the folded over flaps which are visible in FIG. 4*c* may be provided with a cold seal adhesive (indicated by the cross-hatching), similar to that used on self-seal envelopes, so that when the magazine is closed the surfaces of the two flaps stick together. This version has the advantage that the magazine is more securely mounted on the board but without the need for any additional taping in the mounting process.

Figure 4D:
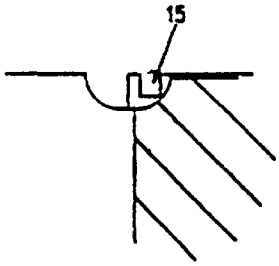

As an alternative, as seen in the closed position of FIG. 4*d*, a piece of tape 15 can be placed over the first flap 3 of the flap pair and stuck onto the back of the board, closing the two flaps 3, 13 together.

Figure 5A:
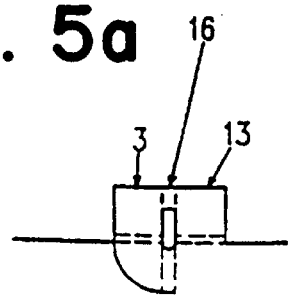
FIGS. 5*a* and 5*b* show a third embodiment of the display board, with the flaps at two different stages of folding.
Figure 5B:
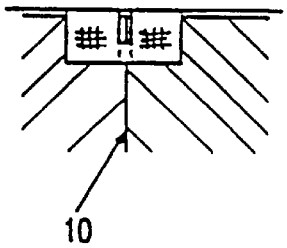

The embodiment of FIG. 5 is similar to that of FIG. 4, except that the two flaps 3, 13 of the flap pair are joined together so that they fold over onto the opened magazine as one. This makes the first folding step rather easier, though careful positioning of the magazine with its spine 10 in line with the fold 16 between the two flap parts is required. In this embodiment also, the flaps may be provided with a cold seal adhesive or they can be taped together after the magazine is closed.

Figure 6A:
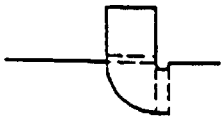
FIGS. 6*a*, 6*b* and 6*c* show alternative formations of the flaps of FIGS. 1 to 4.
Figure 6B:
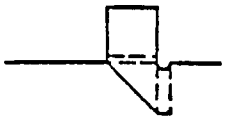
Figure 6C:
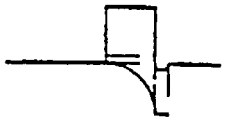

FIGS. 6*a*, 6*b* and 6*c* show alternative designs of the flap shown in the earlier figures. Thus, the cut forming the second flap part B can be of different shapes. It is advantageous that the cut does not form a straight edge in the closed position of the magazine, so as to reduce the possibility of the magazine tearing if it is opened while still attached to the board. The shape of the flap of FIGS. 1 to 5 is thus preferred.

In the embodiment of FIG. 7, each flap is formed of four flap parts. Flap parts and A' and A" correspond to flap part A of the embodiment of FIG. 2; flap parts B' and B" correspond to flap part B of the embodiment of FIG. 2. The flap extends out of the display board with flap parts B' and B" being furthest from the edge of the board. Fold lines 17, 18, 19 and 20 are provided between the board and flap part A' between flap part A' and flap part A"; between flap part A" and flap part B' and between flap part B' and flap part B' respectively.

Figure 7A:
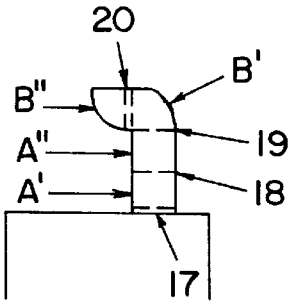
FIGS. 7*a* to 7*f* shows a fourth embodiment of the display board, with the flap at different stages of folding.
Figure 7B:
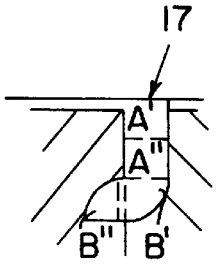
Figure 7C:
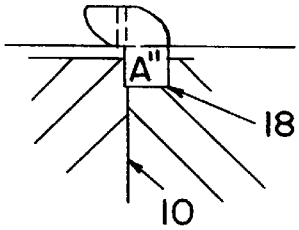

As shown in FIG. 7*b*, the first folding step is to fold the flap about fold-line 17, so that all four flap parts are on top of the board and the magazine. Parts A', B' and B" are then folded back about fold-line 18. In this position, seen in FIG. 7*c*, flap parts A' and A" are equivalent to the flap part A in FIG. 2*c*, on top of the magazine. However, in the embodiment of FIG. 7, flap parts A' and A" are positioned to the right of the spine of the magazine.

Figure 7D:
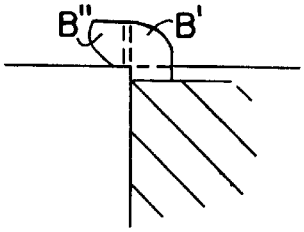
Figure 7E:
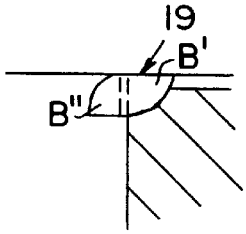
Figure 7F:
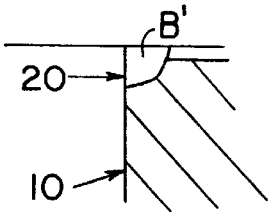

As shown in FIG. 7*d*, the next step is for the magazine to be closed. Flap parts B' and B" are then folded over on top of the magazine about fold-line 19. This position is shown in FIG. 7*e*. Flap part B" is then folded behind the magazine into its final position, shown in FIG. 7*f*. It will thus be appreciated that fold-line 20, which is at right angles to the edge of the display board, is equivalent to fold-line 7 of FIG. 2*d*; like in that figure it is, in the final position of the magazine, immediately behind the spine 10. Thus, the magazine is prevented from moving to the left in FIG. 7. Flap parts A' and A" folded inside the magazine remain to the right of the spine 10 and so prevent it from moving to the right.

Figure 8A:
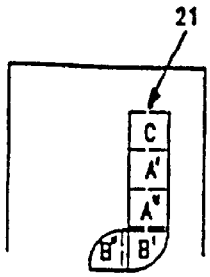
FIGS. 8*a* and 8*b* show a fifth embodiment of the display board, with a flap similar to that of FIG. 7 but cut from the body of the board.
Figure 8B:
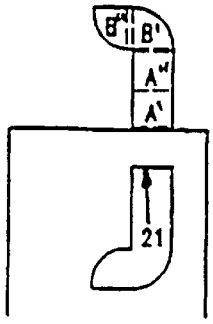

As shown in FIG. 8, the pattern of the flap of FIG. 7 can be cut out of the body of the display board. This has the obvious advantage of saving material and creates a product which is very easy to package and transport, before being used to mount magazines and the like. In other words, the ready-to-use product is rectangular—assuming the shape of the display board is rectangular—with the flaps simply being cut or punched from the interior of the board.

It should be understood that to create a flap equivalent to that of FIG. 7, it is necessary to fold the flap shown in FIG. 8 out of the body of the board about fold-line 21. The flap is then folded onto the magazine in the same fashion as shown in FIG. 7. It is immaterial that a recess is left in the display board, after the flap is folded out, because this recess is almost entirely hidden by the mounted magazine.

The flap of FIG. 8 thus has an extra flap part C which, when the flap is folded out, abuts the rear edge portion of the display board. Flap part C does not, however, play a further part in the formation of the support for the magazine.

In the embodiment of FIG. 9, the flap is formed of five flap parts, A', A", B', B" and B'". Between the board and the successive flap parts are fold lines 22, 23, 24, 25 and 26. The flap is folded onto the board and the magazine about fold-line 22 and then folded back along fold line 23 so that flap parts A' and A" form a flap similar to flap part A in FIG. 2*c*. These positions are shown in FIGS. 9*b* and 9*c*.

Figure 9A:
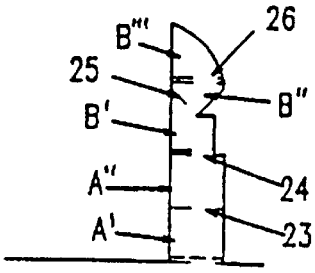
FIGS. 9*a* to 9*g* show a sixth embodiment of the display board, with the flap at different stages of folding.
Figure 9B:
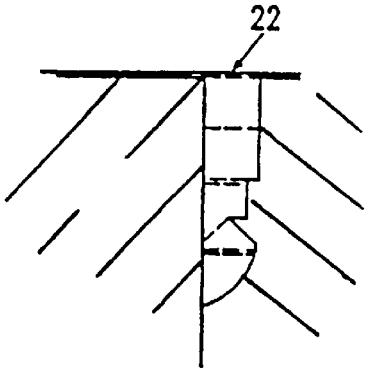
Figure 9C:
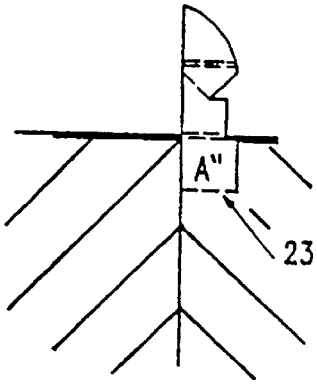
Figure 9D:
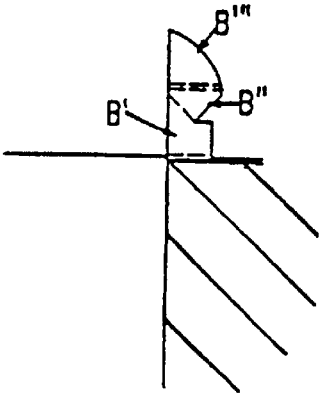
Figure 9E:
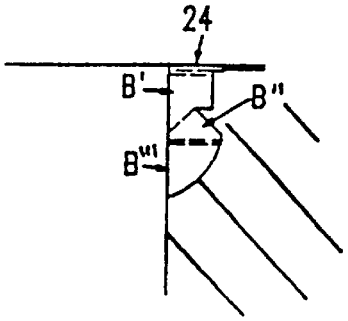
Figure 9F:
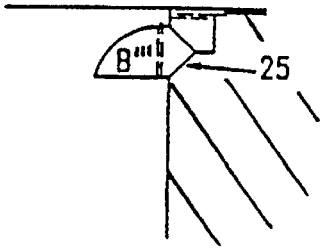
Figure 9G:
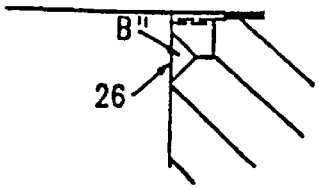

As shown in FIGS. 9*d* and 9*e*, the magazine is then closed on top of flap part A' and A" and flap part B', B" and B'" are folded about line 24 on top of the magazine. Flap part B" and B'" are then folded back along diagonal fold-line 25, as seen in FIG. 9*f*. Flap part B'" is then folded behind the magazine, about fold-line 26, as shown in FIG. 9*g*. It will be understood that fold-line 26, which in this position is at right-angles to the edge of the display board, is equivalent to fold-line 7 in the embodiment of FIG. 2. In other words, fold-line 26 is, in the final position of the flaps, behind the spine of the magazine, preventing it from moving to the left. It is immaterial that, in the open position of the flap shown in FIG. 9*a*, fold-line 21 is parallel to the edge of the board; by virtue of the diagonal fold-line 25, in the folded position of the flap, fold-line 26 assumes a position at right-angles to the edge of the board.

Figure 10A:
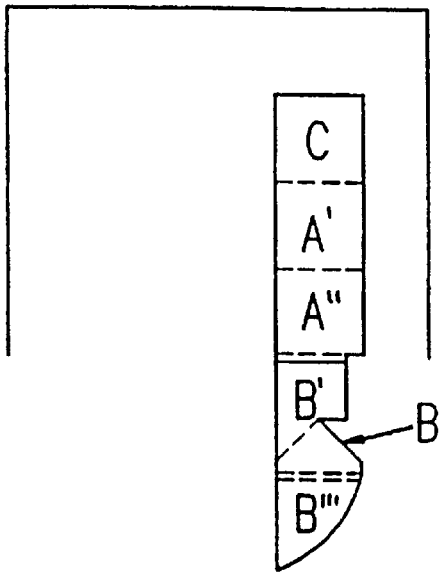
FIGS. 10*a* and 10*b* show a seventh embodiment of the display board, with a flap similar to that of FIG. 9 but cut out of the board.
Figure 10B:
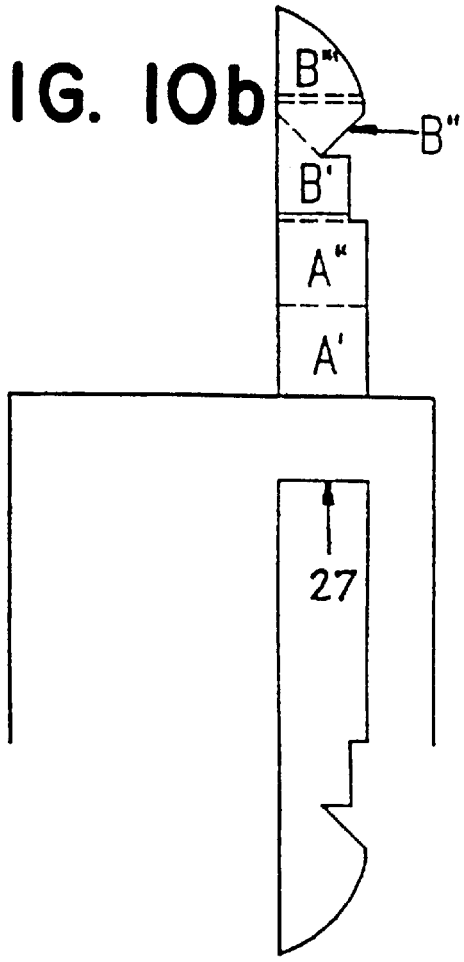

FIGS. 10*a* and 10*b* shows a embodiment of the display board which is similar to that of FIG. 9, but with the flap cut out of the body of the board, as with the embodiment of FIG. 8. The flap thus has an extra flap part C so that it can be folded out about fold-line 27 to assume the position shown in FIG. 9*a*. Flap parts A', A", B', B" and B'" are then folded in the same manner as shown in FIG. 9.

Figure 11:
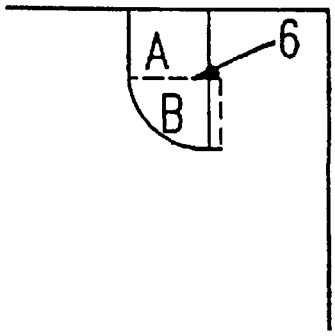
FIGS. 11 and 12 show eight and ninth embodiments of the display board.
Figure 12:
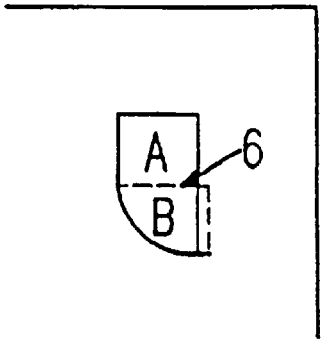

In the embodiments of FIGS. 11 and 12, the flaps are like those of FIGS. 1 and 2 but are cut out from the body of the display board. This means that when the folded article is mounted on the board, its edge does not follow the edge of the display board; instead its edge is inward of the edge of the board. These embodiments can optionally include the additional flap part 13, shown in FIG. 4, cut out from the body of the board in a corresponding fashion. Particularly in the case of FIG. 12, it is clear that the edge of the board need not be parallel to the edge of the magazine and it could be of any desired shape.

In these embodiments, the relevant "edge" of the display board is that formed by fold-line 6, i.e. the edge which is adjacent the edge of the article to be mounted.

For the avoidance of any doubt, it is confirmed that along the opposing edges of the board there could be one, two or three flaps or flap pairs or any number of flaps or flap pairs depending on how many fold-over articles are desired to be mounted on the board. Although the flap parts A have generally been illustrated as being square in shape this is not essential and other shapes could be adopted, for example, rectangular or partly curved. It is, however, obviously convenient for those edges of the flap parts which will be either immediately inside or outside of the spine of the fold-over article to be generally straight, so that they can follow the line of the spine and generally support it. Being exactly at right angles to the edge of the board is not, however, essential and even irregular shapes to the flap parts could be contemplated, provided that adequate support is given to prevent the articles from falling off the board.

Where a magazine is to be mounted, the length of the flaps relative to the length of the magazine's spine is short, because the spine is relatively stiff. With articles whose spine is relatively flexible, the flaps can be formed larger relative to the article to provide additional support.

Needless to say, shapes and designs of the flaps are possible beyond what is described above. It is not intended that the invention be limited to the specific designs of flaps described and illustrated in this application.

I claim:

1. A display board comprising: a body having a pair of opposing edges with at least one flap at each edge, the flaps between them holding a fold-over article, each flap being foldable along the edge onto the body to form an edge fold, so that said flap is inside the fold-over article when that article is on the board, and wherein at least a part of each flap is also foldable at a substantially right angle to the edge to form a right angle fold, so that upon mounting of the article on the board, folding each flap inside the article adjacent its spine and then folding the article onto itself, part of each flap is arranged on top of the article with the substantially right angle fold of each flap behind the spine of the article to prevent the article from falling off the display board.

2. A display board according to claim 1, wherein each flap is formed of a first flap part, which, in its open state, extends outwardly from the body, and a second flap part cut into the body, the substantially right angle fold being formed in the board from an inner end of the cut of the second flap part to the edge of the body.

3. A display board according to claim 1, wherein each flap is formed of at least four flap parts, which extend outwardly from the body, first and second flap parts fold onto one another to form a flap which folds inside the article, and the remaining flap parts providing the substantially right angle fold and together forming a part extending outside the article, behind its spine.

4. A display board according to claim 1, wherein each flap is completely cut out of the body of the board and bent away from the body before the article is mounted on the board.

5. A display board according to claim 1, wherein adjacent each flap is a second flap foldable inside the article when it is mounted on the display board so that when the article is itself folded over to close it, the two flaps, one on either side of the spine of the article, abut one another.

6. A display board according to claim 5, wherein the abutting flaps have adhesive on their faces so that when the article is closed the flaps adhere to one another.

7. A display board according to claim 1, wherein there are at least two sets of flaps, each flap on one edge having a counterpart on the opposite edge of the board.

8. A display board according to claim 1, wherein the folds of the flaps are defined by one of score lines, perforations and creases in the body.

9. A display board according to claim 1, wherein the body includes a display area, not covered by the mounted article, on which one of additional information and pictures are mountable.

10. A display board according to claim 1, wherein the flaps are integral with the body.

11. A display board according to claim 1, wherein the display board is formed of one of card and cardboard.

12. A display board according to claim 1, wherein the flaps are disposed adjacent outer edges of the body so that said opposing edges follow a periphery of the body.

13. A display board according to claim 1, wherein the display board is substantially rectangular.

14. A display board according to claim 1, wherein each flap comprises a substantially square part and a part in a shape of a quarter circle cut into the body.

15. A combination of a display board according to claim 1 and a magazine.

16. A combination according to claim 15, further comprising a supplement.

17. A display board for holding an article folded over-itself along a fold to create a spine, comprising:

a body having a pair of opposing edges;

at least one flap at each edge of said pair for engaging said article, each flap comprising:

a first flap part foldable along a first fold line for positioning inside the article to be held on the display board;

a second flap part being disposed between said first flap part and one edge of said pair, said second flap being foldable along a second fold line at a substantially right angle to one edge of the pair for overlapping the spine of said article while said first flap part is positioned inside so as to hold said article on said display board between said at least one flap at each edge of the pair and between said first and second flap parts.

18. A display board according to claim 17, wherein said first flap part extends outwardly of said body prior to being folded, and said second flap part is formed in said body by a cut extending from one edge of said pair into said body, with the second fold line extending between the cut and said one edge.

19. A display board according to claim 17, wherein said first and second flap parts each comprise two sub-parts, said two sub-parts of said first flap part being foldable onto one another along a third fold line for positioning said two sub-parts of said second flap part outside said article when said first flap part is positioned inside said article, and said two sub-parts of said second flap part being foldable at a substantially right angle to one edge of the pair so as to extend on either side of the spine of said article.

20. A display board according to claim 17, wherein said first and second flap parts of each flap are cut out of said body while remaining joined thereto and bent away therefrom prior to said article being mounted thereon.

21. A display board according to claim 17, further comprising another flap adjacent each flap, said another flap being foldable with said first flap parts for positioning inside said article to be held on said display board on opposite sides of the fold, said second flaps and first flap parts being adapted to abut on another when folded inside said article.

22. A display board according to claim 21, wherein said second flaps are adhered by an adhesive to said first flap parts when abutted together.

23. A display board according to claim 17, wherein said at least one flap comprises at least two sets of flaps, each flap on one edge of the pair having a counterpart on the opposite edge of said body.

24. A display board according to claim 17, wherein the first and second fold lines are defined by formations selected from the group consisting of score lines, perforations and creases in the flaps.

25. A display board according to claim 17, wherein said body includes a display area, not covered by said article held thereon, for displaying additional information.

26. A display board according to claim 17, wherein said at least one flap is integral with said body.

27. A display board according to claim 17, wherein said body is formed of a material selected from the group consisting of card and cardboard.

28. A display board according to claim 17, wherein said body is substantially rectangular.

29. A display board according to claim 17, wherein said first flap part has a substantially square shape and said second flap has a quarter circle shape cut into said body.

30. A display board according to claim 17, in combination with a magazine.

* * * * *